US008632158B2

(12) United States Patent
Tsuboi et al.

(10) Patent No.: US 8,632,158 B2
(45) Date of Patent: Jan. 21, 2014

(54) LIQUID EJECTION APPARATUS

(75) Inventors: Motohiro Tsuboi, Nagoya (JP); Masayuki Okumura, Nagoya (JP); Kiyoshi Sugimoto, Kuwana (JP); Shinya Yamamoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/429,411

(22) Filed: Mar. 25, 2012

(65) Prior Publication Data

US 2013/0050334 A1 Feb. 28, 2013

(30) Foreign Application Priority Data

Aug. 31, 2011 (JP) ..... 2011-188250

(51) Int. Cl.
*B41J 2/165* (2006.01)

(52) U.S. Cl.
USPC ..... 347/32

(58) Field of Classification Search
USPC ..... 347/32
See application file for complete search history.

(56) References Cited

U.S. PATENT DOCUMENTS

| | | | | |
|---|---|---|---|---|
| 6,578,945 | B2 * | 6/2003 | Hashi et al. | 347/22 |
| 2001/0033308 | A1 | 10/2001 | Fujimoto et al. | |
| 2003/0081055 | A1 * | 5/2003 | Wotton et al. | 347/33 |
| 2003/0202036 | A1 | 10/2003 | Fujimoto et al. | |
| 2005/0062793 | A1 | 3/2005 | Takagi et al. | |
| 2005/0088481 | A1 | 4/2005 | Fujimoto et al. | |
| 2006/0119644 | A1 * | 6/2006 | Berry et al. | 347/29 |
| 2006/0119649 | A1 * | 6/2006 | Berry et al. | 347/32 |
| 2006/0119654 | A1 * | 6/2006 | Berry et al. | 347/32 |
| 2007/0257960 | A1 * | 11/2007 | Berry et al. | 347/32 |
| 2007/0257961 | A1 * | 11/2007 | Berry et al. | 347/32 |
| 2008/0001991 | A1 * | 1/2008 | Berry et al. | 347/32 |
| 2008/0030541 | A1 * | 2/2008 | Berry et al. | 347/32 |
| 2009/0027445 | A1 * | 1/2009 | Chikamoto | 347/29 |
| 2009/0027446 | A1 * | 1/2009 | Taira | 347/33 |
| 2009/0122104 | A1 * | 5/2009 | Berry et al. | 347/30 |
| 2013/0050381 | A1 | 2/2013 | Okumura et al. | |

FOREIGN PATENT DOCUMENTS

| | | | |
|---|---|---|---|
| JP | S63-254044 | A | 10/1988 |
| JP | H07-246711 | A | 9/1995 |
| JP | H09-109403 | A | 4/1997 |
| JP | 2002-347255 | A | 12/2002 |
| JP | 2005-096187 | A | 4/2005 |

* cited by examiner

*Primary Examiner* — Matthew Luu
*Assistant Examiner* — Alexander D Shenderov
(74) *Attorney, Agent, or Firm* — Baker Botts L.L.P.

(57) ABSTRACT

A liquid ejection apparatus is provided. The liquid ejection apparatus includes two line-type heads, each of which includes an ejection surface having a plurality of ejection ports for ejecting liquid to a recording medium; and two covers provided for the two heads, respectively, and each of the covers being movable relative the corresponding head between a protection position where the cover covers the ejection surface of the corresponding head and a retraction position where the cover does not cover the ejection surface of the corresponding head. Each of the heads includes a first side close to a head other than the corresponding head and a second side away from the head other than the corresponding head. The retraction position of each of the covers is located at the second side of the corresponding head.

6 Claims, 6 Drawing Sheets

θ =0°

θ =10°

θ =13°

θ =29°
1a1
1b
10a
10b
10x
11a
11b
12a
12a1
12a2
12b
12b1
12b2
13a
13a1
13a2
13a3
13a4
13b
13b1
13b2
13b3
13b4
14a
14b
θ
VERTICAL DIRECTION
SUB-SCANNING DIRECTION
MAIN SCANNING DIRECTION

θ=0°

θ=10°

θ=13°

θ=29°
1a1
12a1
12a2
12a
12b1
12b2
12b
10a
10b
10x
11a
11b
14a
14b
1b
L1
L2
L3
L4
A
B
θ
VERTICAL DIRECTION
SUB-SCANNING DIRECTION
MAIN SCANNING DIRECTION

LIQUID EJECTION APPARATUS

CROSS-REFERENCE TO RELATED APPLICATION

This application claims priority from Japanese Patent Application No. 2011-188250, filed on Aug. 31, 2011, the entire subject matter of which is incorporated herein by reference.

TECHNICAL FIELD

Aspects of the present invention relate to a liquid ejection apparatus which ejects liquid such as ink.

BACKGROUND

There has been know a liquid ejection apparatus in which an ejection surface of a head is covered with a cover so as to protect the ejection surface from a user's hand or foreign matters (refer to JP 2002-347255A).

In the liquid ejection apparatus described in JP 2002-347255A, a plurality of heads 101 are provided with covers (caps 102), respectively. The covers can take a protection position where the covers cover the ejection surfaces of the corresponding heads and a retraction position where the covers do not cover the ejection surfaces of the corresponding heads. The retraction position of each cover is at the same side of the corresponding head (in FIG. 8 of JP 2002-347255A, the caps 102 are at left sides of the corresponding heads 101, respectively).

However, according to the technique of JP 2002-347255A, since the retraction position of at least one cover is located between the heads, it is not possible to reduce a distance between the heads.

When the distance between the heads is longer, positions on a recording medium, which liquids ejected from the head located at a downstream side of a conveyance direction of the recording medium reach, are deviated, so that a quality of an image is likely to be deteriorated.

SUMMARY

Accordingly, it is an as aspect of the present invention to provide a liquid ejection apparatus capable of reducing a distance between heads in a configuration having covers which cover ejection surfaces of the heads.

According to an illustrative embodiment of the present invention, there is provided a liquid ejection apparatus includes two line-type heads and two covers. Each of the two line-type heads includes an ejection surface having a plurality of ejection ports for ejecting liquid to a recording medium. The two covers are provided for the two heads, respectively, and each of the covers is movable relative the corresponding head between a protection position where the cover covers the ejection surface of the corresponding head and a retraction position where the cover does not cover the ejection surface of the corresponding head. Each of the heads includes a first side close to a head other than the corresponding head and a second side away from the head other than the corresponding head. The retraction position of each of the covers is located at the second side of the corresponding head.

According to the above configuration, a distance between the heads can be reduced in the configuration having the covers which cover the ejection surfaces of the heads.

According to another illustrative embodiment of the present invention, there is provided a liquid ejection apparatus including first and second line-type heads, and first and second covers. Each of the first and second line-type heads includes an ejection surface having a plurality of ejection ports for ejecting liquid to a recording medium. Each of the first and second covers are provided for the first and second heads, respectively, and each of the covers is movable relative the corresponding head between a protection position where the cover covers the ejection surface of the corresponding head and a retraction position where the cover does not cover the ejection surface of the corresponding head. The first and second heads are arranged in an arrangement direction. The retraction position of the first cover with respect to the first head is opposite to the retraction position of the second cover with respect to the second head in the arrangement direction.

BRIEF DESCRIPTION OF THE DRAWINGS

The above and other aspects of the present invention will become more apparent and more readily appreciated from the following description of illustrative embodiments of the present invention taken in conjunction with the attached drawings, in which:

FIGS. 3A and 3B are front views showing a lock mechanism, wherein FIG. 3A shows a state where a first housing is regulated from moving by the lock mechanism and FIG. 3B shows a state where the moving regulation of the first housing by the lock mechanism is released;

FIGS. 4A to 4D show states when an angle formed between the first housing and a second housing is 0°, 10°, 13° and 29°, respectively;

FIGS. 5A to 5D show states when the angle formed between the first housing and the second housing is 0°, 10°, 13° and 29°, respectively.

DETAILED DESCRIPTION

Hereinafter, illustrative embodiments of the present invention will be described with reference to the drawings.

Figure 1:
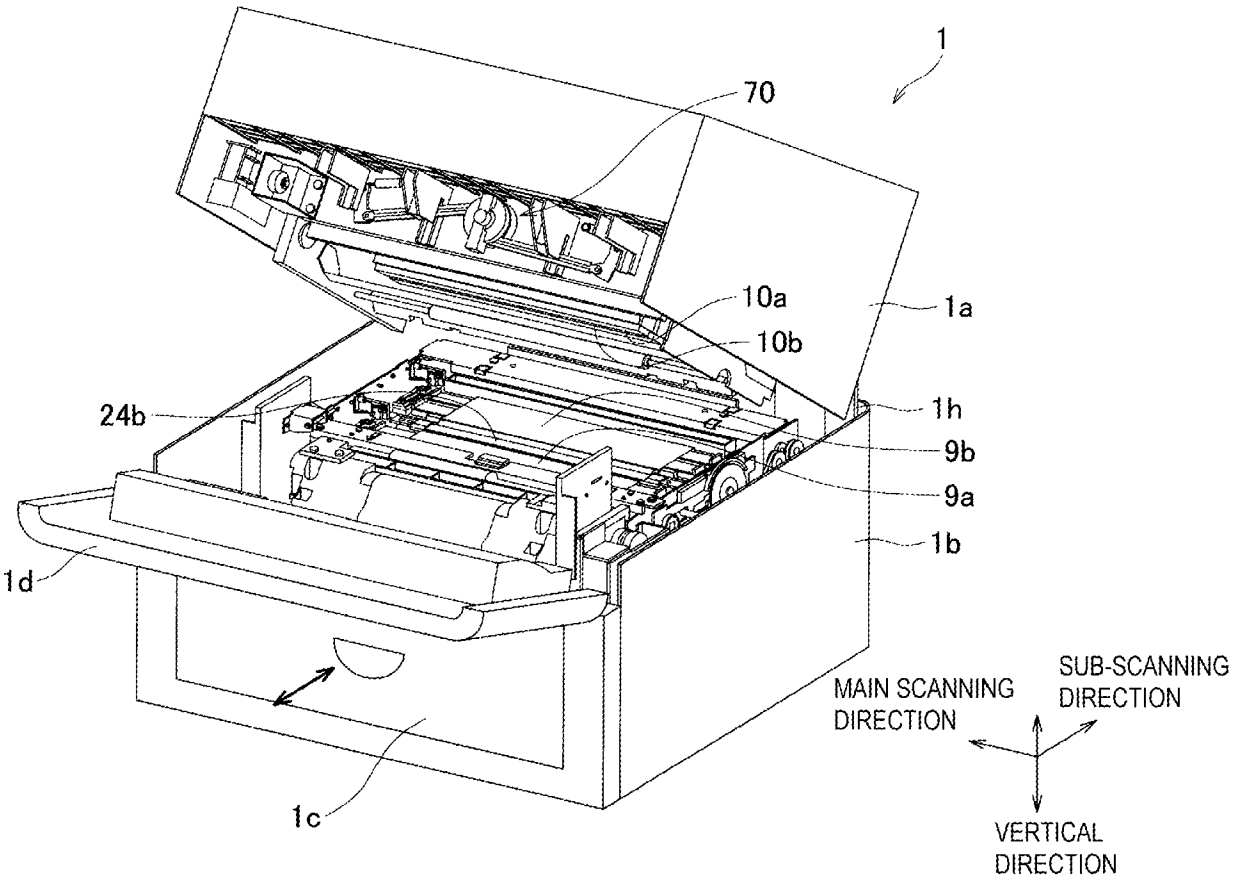
FIG. 1 is a perspective view showing an outer appearance of an inkjet printer according to an illustrative embodiment of the present invention.
Figure 2:
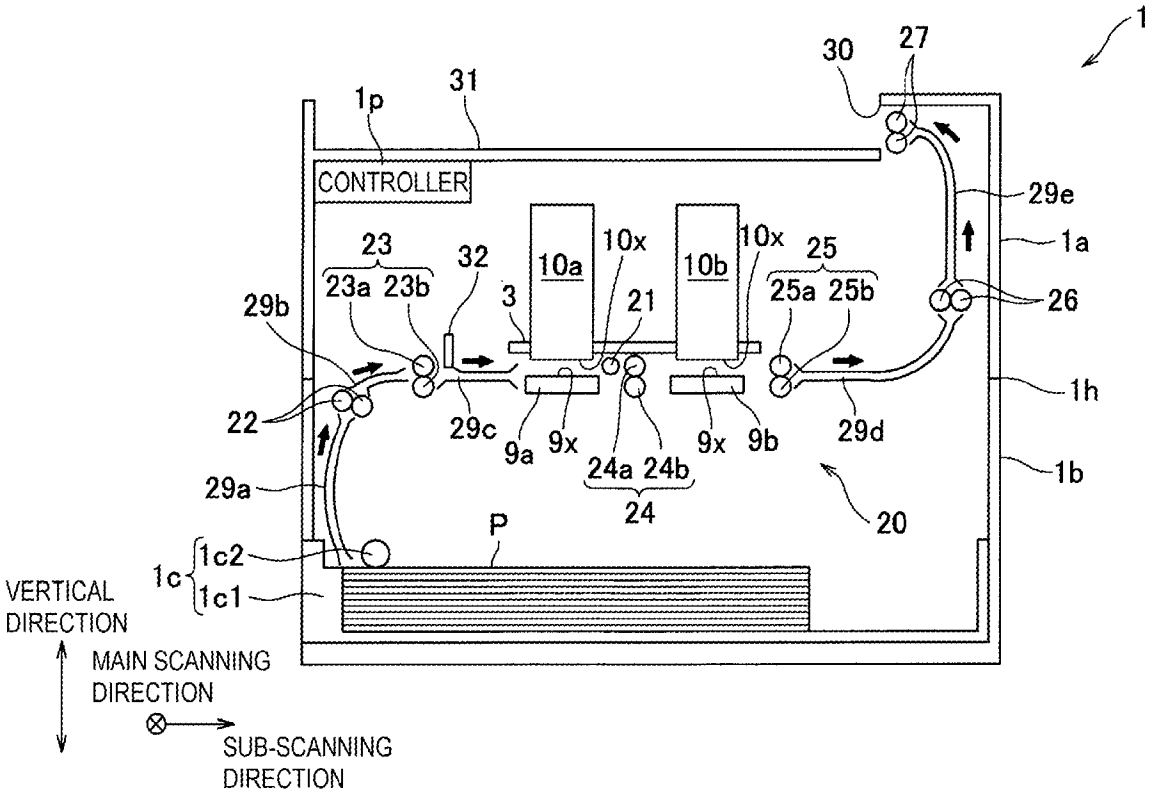
FIG. 2 is a schematic side view showing an interior of the printer.

First, an overall configuration of an inkjet printer 1 according to an illustrative embodiment is described with reference to FIGS. 1 and 2.

The printer 1 includes a first housing 1*a* and a second housing 1*b*, both of which have a rectangular parallelepiped shape and the same size. The first housing 1*a* has an opened lower surface and the second housing 1*b* has an opened upper surface. When the first housing 1*a* overlaps with the second housing 1*b* and the opened surfaces thereof are covered, an interior space of the printer 1 is defined (refer to FIG. 2).

An upper part of a top plate of the first housing 1*a* is provided with a sheet discharge part 31. A space defined by the first and second housings 1*a*, 1*b* is formed with a conveyance path along which a sheet P is conveyed from a feeder unit 1*c* toward the sheet discharge part 31 along thick arrows of FIG. 2.

The first housing 1*a* is rotatable relative to the second housing 1*b* about a hinge part 1*h* located a lower end of one side of the first housing 1*a*. According to the rotation, the first housing 1*a* can take a close position (a position shown in FIG. 2) where the first housing comes close to the second housing 1*b* and a separate position (a position shown in FIG. 1) where the first housing is separated from the second housing 1*b* than the close position. When the first housing 1*a* is located at the separate position, a part of the conveyance path is exposed, so that an operation space of a user is secured between the first housing 1*a* and the second housing 1*b*. The user can use the operation space to manually perform a jam resolving operations of the sheet P on the conveyance path.

The first housing 1*a* is urged from the close position toward the separate position by a spring, for example. The first housing 1*a* can be opened up to a predetermined angle with respect to a horizontal plane and is regulated from being further opened by a stopper and the like. The predetermined angle of the first housing 1*a* with respect to the horizontal plane refers to a state where an angle between the first housing 1*a* and the second housing 1*b* becomes the predetermined angle. The predetermined angle is an angle capable of securing an operation space in which the user can put a hand and perform the jam resolving operations between the first housing 1*a* and the second housing 1*b*. In this illustrative embodiment, the predetermined angle is 29°.

In this illustrative embodiment, the close position is a position along the horizontal plane and the separate position is a position which is inclined to the horizontal plane by about 29°.

A front face of the first housing 1*a* (a left front side in FIG. 1) is provided with a lock mechanism 70 which regulates (prohibits) the first housing 1*a* located as the close position from moving. A front face of the second housing 1*b* is provided with an openable and closable lid 1*d* which covers the front face of the first housing 1*a*. When the lid 1*d* is opened, the lock mechanism 70 is exposed. A configuration of the lock mechanism 70 will be specifically described later.

The first housing 1*a* accommodates therein two heads, two cartridges (not shown) corresponding to the two heads, a controller 1*p* (refer to FIG. 2) configured to control operations of respective units of the printer 1, a part of a conveyance unit 20 (refer to FIG. 2), and the like. The two heads include a pre-coat head 10*a* which ejects pre-processing liquid and an inkjet head 10*b* which ejects black ink, in order from an upstream side of a sheet conveyance direction shown with the thick arrows in FIG. 2. The heads 10*a*, 10*b* have the same configuration and are arranged in a direction (sub-scanning direction) orthogonal to an extending direction (main scanning direction) of the hinge part 1*h* of the first housing 1*a*.

The second housing 1*b* accommodates therein flat plate-shaped platens 9*a*, 9*b* which are provided below the respective heads 10*a*, 10*b*, respectively, the feeder unit 1*c*, a part of the conveyance unit 20, and the like.

The first housing 1*a* is provided with covers 11*a*, 11*b* which are configured to cover ejection surfaces 10*x* of the respective heads 10*a*, 10*b* and a support member 1*a*1 which rotatably supports the covers 11*a*, 11*b* (refer to FIG. 4). In FIGS. 1 and 2, the covers 11*a*, 11*b* and the like are not shown. A configuration of the covers 11*a*, 11*b* and the like will be described later in more detail.

The respective cartridges store the pre-processing liquid and black ink (hereinafter, collectively referred to as 'liquid') which are supplied to the corresponding heads 10*a*, 10*b*, respectively. The pre-processing liquid is liquid having a function of preventing the ink from bleeding or exuding back, a function of improving color expression property or quick-drying of the ink and the like. The liquids in the cartridges are supplied to the corresponding heads 10*a*, 10*b* by driving of a pump and the like.

Each of the heads 10*a*, 10*b* is a line type which is long in the main scanning direction and have a substantially rectangular parallelepiped shape. The heads 10*a*, 10*b* are spaced from each other in the sub-scanning direction and are supported to the first housing 1*a* via a frame 3. The respective heads 10*a*, 10*b* are provided on upper surfaces thereof with joints to which flexible tubes are attached and the ejection surfaces 10*x*, which are the lower surfaces of the respective heads 10*a*, 10*b*, are formed with a plurality of opened ejection ports. The respective heads 10*a*, 10*b* are formed therein with flow paths along which the liquids supplied from the corresponding cartridges via the tubes and joints reach the ejection ports.

The controller 1*p* controls a preparation operation relating to recording, feeding, conveyance and discharge operations of the sheet P, a liquid ejection operation synchronous with the conveyance of the sheet P and the like such that an image is recorded on the sheet P, based on a recording command transmitted from an external apparatus (PC connected to the printer 1, for example).

The controller 1*p* has a ROM (Read Only Memory), a RAM (Random Access Memory: including a non-volatile RAM), an I/F (Interface) and the like, in addition to a CPU (Central Processing Unit) which is a calculation processing device. The ROM stores therein programs which are executed by the CPU, a variety of fixed data and the like. The RAM temporarily stores data (image data and the like) which is necessary when executing the programs. The controller 1*p* transmits and receives data to and from the external apparatus via the I/F.

The feeder unit 1*c* has a sheet feeding tray 1*c*1 and a sheet feeding roller 1*c*2. The sheet feeding tray 1*c*1 is detachably mounted to the lower housing 1*b* in the sub-scanning direction. The sheet feeding tray 1*c*1 is a box which is opened upward and can accommodate therein a plurality of types of sheets P having various sizes. The sheet feeding roller 1*c*2 is rotated under control of the controller 1*p* and feeds the uppermost sheet P in the sheet feeding tray 1*c*1.

The platens 9*a*, 9*b* are arranged to face the ejection surfaces 10*x* of the corresponding heads 10*a*, 10*b* in a vertical direction. Surfaces of the platens 9*a*, 9*b* are support surfaces 9*x* which support the sheet P from a backside thereof while facing the ejection surfaces 10*x* of the corresponding heads 10*a*, 10*b*. The respective heads 10*a*, 10*b* are supported to the frame 3 such that a predetermined gap appropriate for recording is formed between the ejection surfaces 10*x* and the support surfaces 9*x* when performing a recording operation.

The conveyance unit 20 has roller pairs 22, 23, 24, 25, 26, 27, guides 29*a*, 29*b*, 29*c*, 29*d*, 29*e* and an intermediate roller 21.

Among the constitutional elements of the conveyance unit 20, the intermediate roller 21, an upper roller 24*a* of the roller pair 24, the roller pairs 26, 27 and the guides 29*d*, 29*e* are provided (supported) to the first housing 1*a*. The roller pairs 22, 23, 25, a lower roller 24*b* of the roller pair 24 and the guides 29*a*, 29*b*, 29*c* are provided (supported) to the second housing 1*b*.

The roller pairs 22 to 27 are arranged in the order from an upstream side of the conveyance direction so as to form the conveyance path from the feeder unit 1*c* to the sheet discharge part 31. The lower rollers 23*b*, 24*b*, 25*b* of the roller pairs 23 to 25 are driving rollers which are connected to a conveyance motor (not shown) and are rotated under driving control of the conveyance motor by the controller 1*p*. The upper rollers 23*a*, 24*a*, 25*a* of the roller pairs 23 to 25 are driven rollers. Also, in the respective roller pairs 26, 27, one roller is a driving roller and the other roller is a driven roller. Also, while the lower rollers 23*b* to 25*b* of the roller pairs 23 to 25 are rubber rollers having a rubber layer on an outer periphery thereof, the upper rollers 23*a* to 25*a* of the roller pairs 23 to 25 and the intermediate roller 21 are spur rollers having a metal layer formed with a plurality of protrusions on an outer periphery thereof.

The guides 29*a* to 29*e* are arranged in the order from an upstream side of the conveyance direction between the feeder unit 1*c* and the roller pair 22 and between the respective roller pairs so as to form the conveyance path. Each of the guides 29*a* to 29*e* is configured by a pair of plates which are spaced from each other in a plane direction.

The intermediate roller 21 is arranged at an upper position of the conveyance path between the head 10*a* and the roller pair 24. In other words, the intermediate roller 21 is arranged at a position which faces a surface (a recording surface on which an image is formed) of the sheet P between the head 10*a* and the roller pair 24.

The sheet P fed from the feeder unit 1*c* passes between the plates of the guides 29*a* to 29*e* and is conveyed in the conveyance direction while it is put between the roller pairs 22 to 27.

When the sheet P sequentially passes below the heads 10*a*, 10*b* with being supported on the support surfaces 9*x*, the respective heads 10*a*, 10*b* are driven under control of the controller 1*p*, so that the liquid is ejected from the ejection ports of the respective ejection surfaces 10*x* toward the surface of the sheet P. As the liquid is ejected from the ejection ports of the respective ejection surfaces 10*x* toward the surface of the sheet P, an image is formed on the sheet P. The liquid ejection operation from the ejection ports is performed under control of the controller 1*p*, based on a detection signal from a sheet sensor 32. After that, the sheet P is conveyed upward and discharged to the sheet discharge part 31 through an opening 30 which is formed at the upper part of the first housing 1*a*.

In the below, the configuration of the lock mechanism 70 is described with reference to FIGS. 3A and 3B.

The lock mechanism 70 includes a cylindrical rotary member 71, two interlocking members 73*a*, 73*b*, two swing members 74*a*, 74*b*, two springs 76*a*, 76*b* and two fixed members 75*a*, 75*b*. One longitudinal ends of the interlocking members 73*a*, 73*b* are respectively connected to a peripheral surface of the rotary member 71. The swing members 74*a*, 74*b* are respectively formed with recess portions 74*c*, 74*d* which are opened in a direction separating away from the rotary member 71*a*. The fixed member 75*a*, 75*b* are provided with shaft members 75*c*, 75*d* which can be respectively received in (engaged with) the recess portions 74*c*, 74*d*. In the meantime, swing shafts of the swing members 74*a*, 74*b* are fixed to the first housing 1*a*. One ends of the springs 76*a*, 76*b*, which are close to the rotary member 71*a*, are respectively fixed to the first housing 1*a*. Also, the fixed members 75*a*, 75*b* are respectively fixed to the second housing 1*b*.

A rod-shaped knob 72 is fixed on a front face of the rotary member 71. The knob 72 is integrally rotated with the rotary member 71. The springs 76*a*, 76*b* urge upper ends of the swing members 74*a*, 74*b* in a direction coming close to the rotary member 71. Thereby, under a state where external force is not applied, the respective parts of the lock mechanism 70 are stationary with the knob 72 extending in a vertical direction, as shown in FIG. 3A.

Figure 3A:
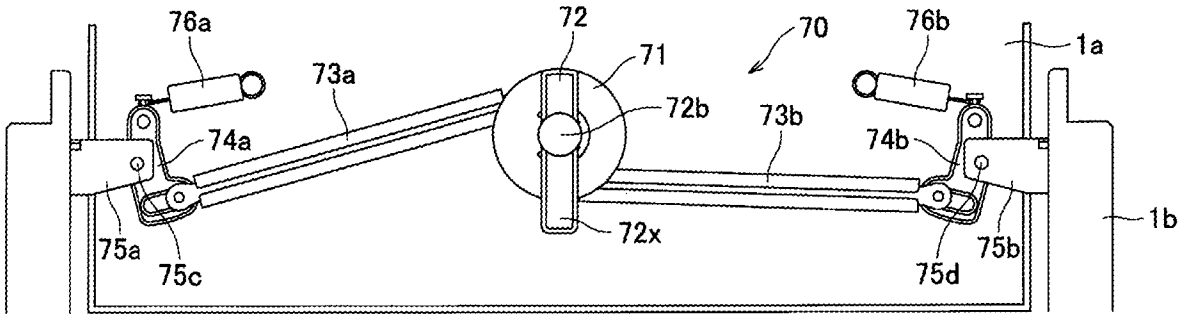
Figure 3B:
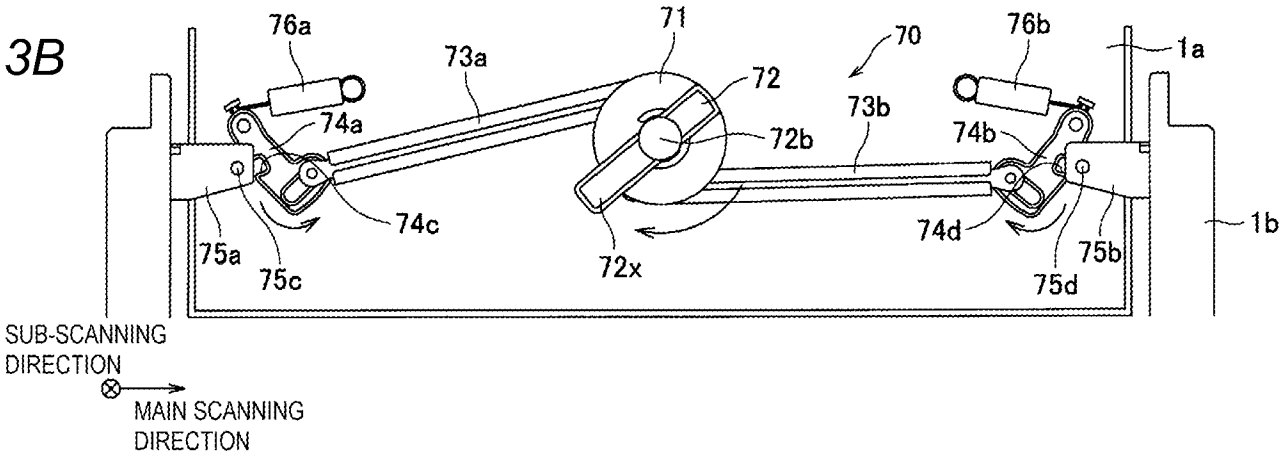

At a state shown in FIG. 3A, the recess portions 74*c*, 74*d* are respectively engaged to the shaft members 75*c*, 75*d*. By this engagement, the moving of the first housing 1*a* is regulated such that the first housing 1*a* at the close position is not rotated toward the separate position. When a user rotates the knob 72 in a clockwise direction against the urging force of the springs 76*a*, 76*b*, the recess portions 74*c*, 74*d* are separated from the shaft members 75*c*, 75*d*. Thereby, the moving regulation of the first housing 1*a* is released.

When the first housing 1*a* is returned to the close position from the separate position, the engagement between the recess portions 74*c*, 74*d* and the shaft members 75*c*, 75*d* is restored. Thereby, the moving of the first housing 1*a* is again regulated by the lock mechanism 70.

In the below, the configuration and operation of the covers 11*a*, 11*b* are described with reference to FIGS. 4A to 4D, 5A to 5D and 6.

As shown in FIGS. 4A to 4D, the covers 11*a*, 11*b* are supported to the support member 1*a*1 via side plates 12*a*, 12*b*. The support member 1*a*1 supports the frame 3 in addition to the side plates 12*a*, 12*b* and intermediate members 13*a*, 13*b*. The frame 3 supports the heads 10*a*, 10*b*.

Figures 4A, 4B, 4C, 4D:
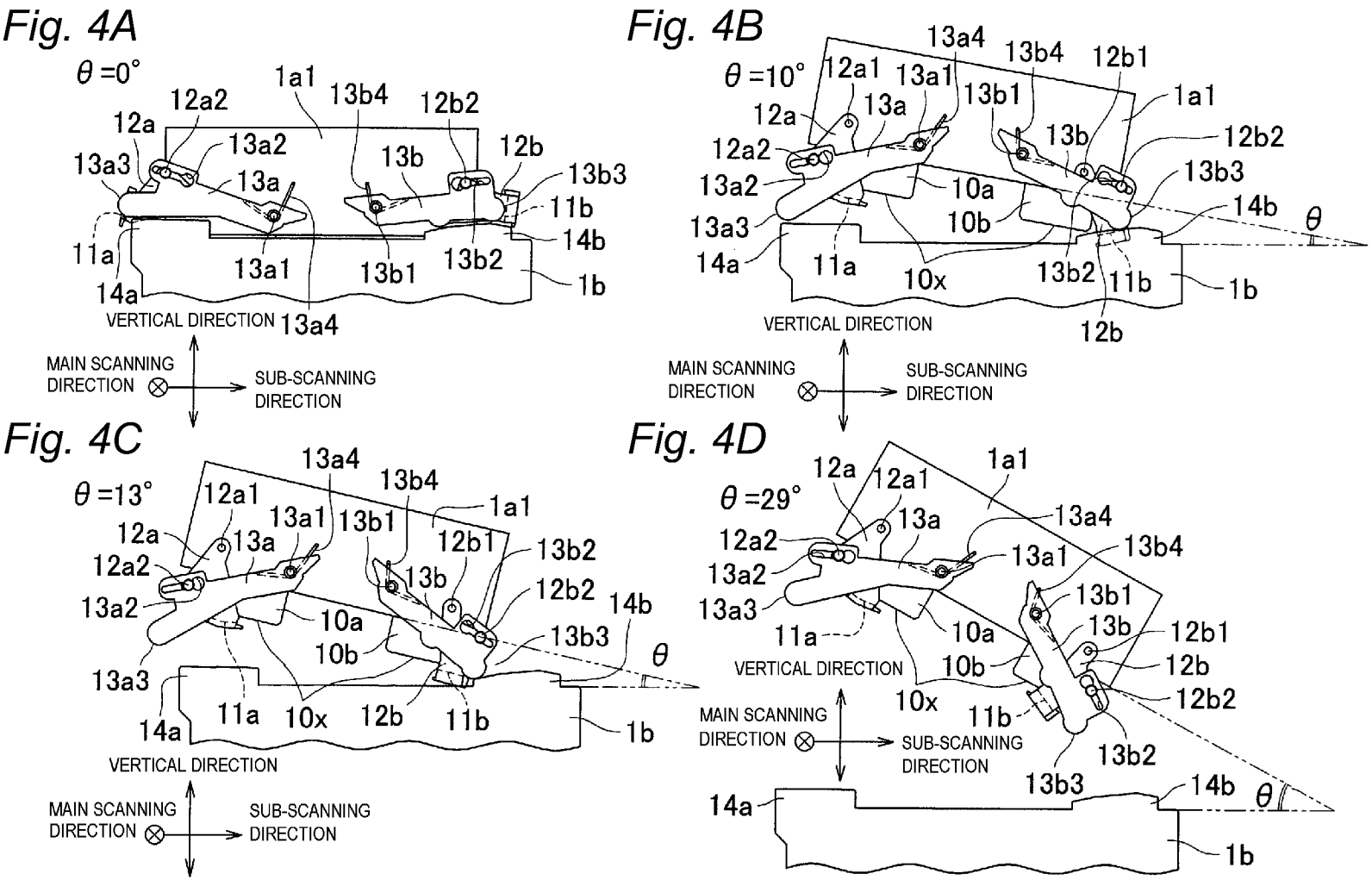
FIGS. 4A to 4D are schematic side views of the printer showing operations of covers when the first housing is moved from a close position to a separate position, and specifically.

The covers 11*a*, 11*b* have a substantially rectangular plate-shaped member which is long in the main scanning direction, respectively. Lengths of the covers 11*a*, 11*b* in the main scanning direction are longer than those of the ejection surfaces 10*x* of the heads 10*a*, 10*b*, respectively. Lengths of the covers 11*a*, 11*b* in the sub-scanning direction are a little shorter than those of the heads 10*a*, 10*b*, respectively. The covers 11*a*, 11*b* can be moved relative to the heads 10*a*, 10*b*, respectively, between a protection position (a position shown in FIG. 4D) where the covers cover the ejection surfaces 10*x* of the corresponding heads 10*a*, 10*b* and a retraction position (a position shown in FIG. 4A) where the covers do not cover the ejection surfaces 10*x*. As shown in FIG. 4A, the retraction position of the cover 11*a* is provided at a left side of the head 10*a* and the retraction position of the cover 11*b* is provided at a right side of the head 10*b*.

At the protection position (refer to FIG. 4D), the covers 11*a*, 11*b* face the ejection surfaces 10*x* in the direction orthogonal to the ejection surfaces 10*x*, and at the retraction position (refer to FIG. 4D), the covers do not face the ejection surfaces 10*x* in the direction orthogonal to the ejection surfaces 10*x*.

The covers 11*a*, 11*b* are moved according to the rotation of the first housing 1*a* such that the covers take the retraction position (refer to FIG. 4A) when the first housing 1*a* is located at the close position and take the protection position (refer to FIG. 4D) when the first housing 1*a* is located at the separate position. The side plates 12*a*, 12*b*, the intermediate members 13*a*, 13*b*, torsion coil springs 13*a*4, 13*b*4 and guide parts 14*a*, 14*b* formed at the second housing 1*b* function as a moving mechanism for realizing the above movement.

The side plates 12*a*, 12*b* are fixed to both ends of the covers 11*b*, 11*b* in the main scanning directions and are rotatably supported to the support member 1*a*1 via shafts 12*a*1, 12*b*1. That is, the covers 11*a*, 11*b* can be rotated relative to the support member 1*a*1 about the shafts 12*a*1, 12*b*1.

The side plates 12*a*, 12*b* have pins 12*a*2, 12*b*2 which protrude outward in the main scanning direction. The pins 12*a*2, 12*b*2 are inserted into long holes 13*a*2, 13*b*2 which are formed at the intermediate members 13*a*, 13*b*. Tip ends of the pins 12*a*2, 12*b*2 are arranged outside the long holes 13*a*2, 13*b*2 and have diameters larger than widths of the long holes 13*a*2, 13*b*2. That is, the tip ends of the pins 12*a*2, 12*b*2 are enlarged, so that the pins 12*a*2, 12*b*2 are prevented from being separated from the long holes 13*a*2, 13*b*2 and the engagement of the intermediate members 13*a*, 13*b* and the side plates 12*a*, 12*b* is kept.

The intermediate members 13*a*, 13*b* are engaged with the side plates 12*a*, 12*b* via the pins 12*a*2, 12*b*2 and are rotatably supported to the support member 1*a*1 via shafts 13*a*1, 13*b*1. The intermediate members 13*a*, 13*b* are located at more outward positions than the side plates 12*a*, 12*b* (except for the pins 12*a*2, 12*b*2) in the main scanning direction. The shafts 13*a*1, 13*b*1 of the intermediate members 13*a*, 13*b* are located at positions closer to a center of the support member 1*a*1 than the shafts 12*a*1, 12*b*1 of the corresponding side plates 12*a*, 12*b* in the sub-scanning direction, and rotating radii of the intermediate members 13*a*, 13*b* are larger than those of the side plates 12*a*, 12*b*, respectively. In other words, the shafts 13*a*1, 13*b*1 are provided between the shafts 12*a*1, 12*b*1.

The intermediate members 13*a*, 13*b* are long members having one ends to which the shafts 13*a*1, 13*b*1 are provided and the other ends 13*a*3, 13*b*3 spaced from the shafts 13*a*1, 13*b*1, and are rotated about the shafts 13*a*1, 13*b*1 according to respective contact states of the other ends 13*a*3, 13*b*3 with the guide parts 14*a*, 14*b*.

The torsion coil springs 13*a*4, 13*b*4 are provided to the shafts 13*a*1, 13*b*1 of the intermediate members 13*a*, 13*b*. More specifically, the torsion coil springs 13*a*4, 13*b*4 are provided to the shafts 13*a*1, 13*b*1 of the intermediate members 13*a*, 13*b* serving as guide rods. One ends of the torsion coil springs 13*a*4, 13*b*4 are fixed to the support member 1*a*1 and the other ends of the torsion coil springs 13*a*4, 13*b*4 are fixed to the intermediate members 13*a*, 13*b*. Thereby, the intermediate members 13*a*, 13*b* are applied with urging forces of counterclockwise and clockwise directions, respectively. That is, the covers 11*a*, 11*b* are respectively urged from the retraction position toward the protection position by the urging forces of the torsion coil springs 13*a*4, 13*b*4.

The guide parts 14*a*, 14*b* are plate-shaped protrusions which are provided on an upper end surface of the second housing 1*b*. The guide parts 14*a*, 14*b* have a substantially rectangular shape, respectively, when seen from the main scanning direction. While an upper end surface of the guide part 14*a* extends horizontally, an upper end surface of the guide part 14*b* has a mountain shape having two inclined portions which are inclined with respect to a horizontal plane in an opposite direction to each other from an apex.

In the meantime, the side plates 12*a*, 12*b*, the intermediate members 13*a*, 13*b* and the guide parts 14*a*, 14*b* are provided at both ends of the covers 11*a*, 11*b* in the main scanning direction. That is, although only the configuration of the covers 11*a*, 11*b* at one end side in the main scanning direction is shown in FIGS. 4A to 4D and 5A to 5D, the configuration of the covers 11*a*, 11*b* at the other end side in the main scanning direction is also the same.

Subsequently, the operations of the intermediate members 13*a*, 13*b*, the side plates 12*a*, 12*b* and the covers 11*a*, 11*b* are specifically described when the first housing 1*a* is moved from the close position to the separate position. When a user lifts up the first housing 1*a*, the first housing is moved from the close position (refer to FIG. 2) to the separate position (refer to FIG. 1). At this time, the support member 1*a*1 is moved together with the first housing 1*a*.

Figures 5A, 5B, 5C, 5D:
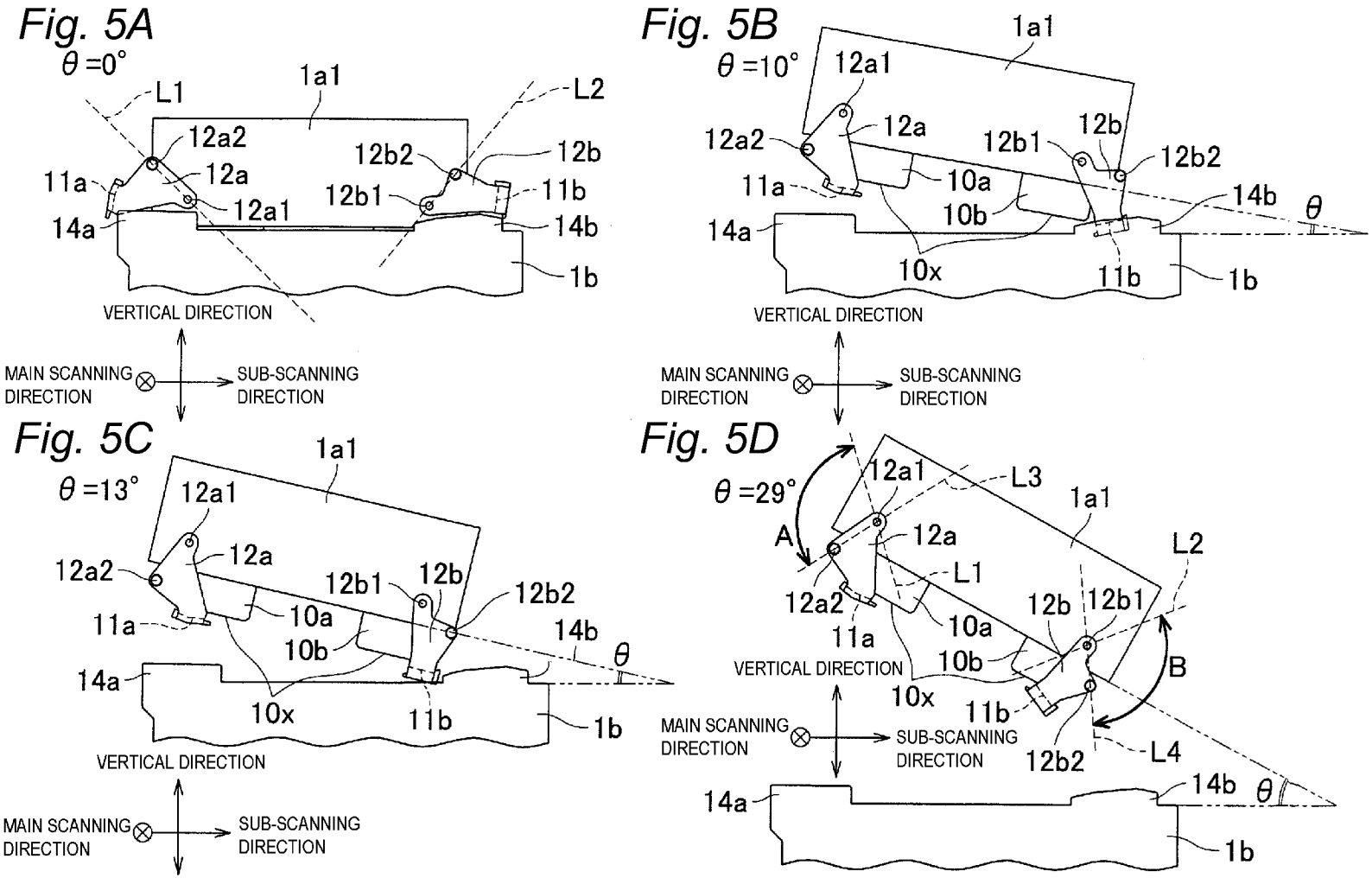
FIGS. 5A to 5D are schematic side views of the printer showing operations of the covers when the first housing is moved from the close position to the separate position, in which intermediate members are not shown, and specifically.

When the first housing 1*a* is located at the close position, an angle θ formed between the first housing 1*a* and the second housing 1*b* is 0 (zero) ° (refer to FIGS. 4A and 5A). At this time, the intermediate members 13*a*, 13*b* are stationary with the other ends 13*a*3, 13*b*3 contacting the upper end surfaces of the guide parts 14*a*, 14*b*, respectively. The side plates 12*a*, 12*b* are stationary with being engaged to the intermediate members 13*a*, 13*b* via the pins 12*a*2, 12*b*2.

When the first housing 1*a* is moved from the close position toward the separate position, a distance between the support member 1*a*1 and the guide parts 14*a*, 14*b* is increased. At this time, since the urging forces of the torsion coil springs 13*a*4, 13*b*4 are applied to the shafts 13*a*1, 13*b*1, the intermediate members 13*a*, 13*b* are rotated with the other ends 13*a*3, 13*b*3 contacting the guide parts 14*a*, 14*b*, respectively. That is, the intermediate members 13*a*, 13*b* are rotated about the shafts 13*a*1, 13*b*1 in the clockwise and counterclockwise directions in FIG. 4, respectively, according to the contact states of the other ends 13*a*3, 13*b*3 with the upper end surfaces of the guide parts 14*a*, 14*b*. As the intermediate members 13*a*, 13*b* are rotated, the pins 12*a*2, 12*b*2 are moved in the long holes 13*a*2, 13*b*2, so that the side plates 12*a*, 12*b* are rotated about the shafts 12*a*1, 12*b*1 in the counterclockwise and clockwise directions in FIG. 5B, respectively.

In the course of the angle θ reaching 10° from 0°, the other end 13*b*3 of the intermediate member 13*b* is moved along the right inclined part toward the apex while contacting the right inclined part of the upper end surface of the guide part 14*b* shown in FIGS. 4A and 5A.

When the angle θ is 10° (refer to FIG. 4B), the cover 11*a* has reached the protection position but the cover 11*b* has not reached the protection position yet.

In the course of the angle θ reaching 13° from 10°, the other end 13*a*3 of the intermediate member 13*a* is separated from the guide part 14*a*. The other end 13*b*3 of the intermediate member 13*b* is moved along the left inclined part in a direction separating away from the apex while contacting the left inclined part of the upper end surface of the guide part 14*b* shown in FIGS. 4B and 5B.

When the angle θ is 13° (refer to FIG. 4C), the cover 11*a* has reached the protection position but the cover 11*b* has not yet reached the protection position.

In the course of the angle θ reaching 29° from 13°, the other end 13*b*3 of the intermediate member 13*b* is separated from the guide part 14*b*.

When the angle θ is 29° (refer to FIGS. 4D and 5D), i.e., when the first housing 1*a* is at the separate position, both the covers 11*a*, 11*b* have reached the protection position. That is, in the course of the angle θ reaching 29° from 0°, the covers 11*a*, 11*b* are moved from the retraction position to the protection, as shown in FIGS. 5A to 5D.

Figure 6:
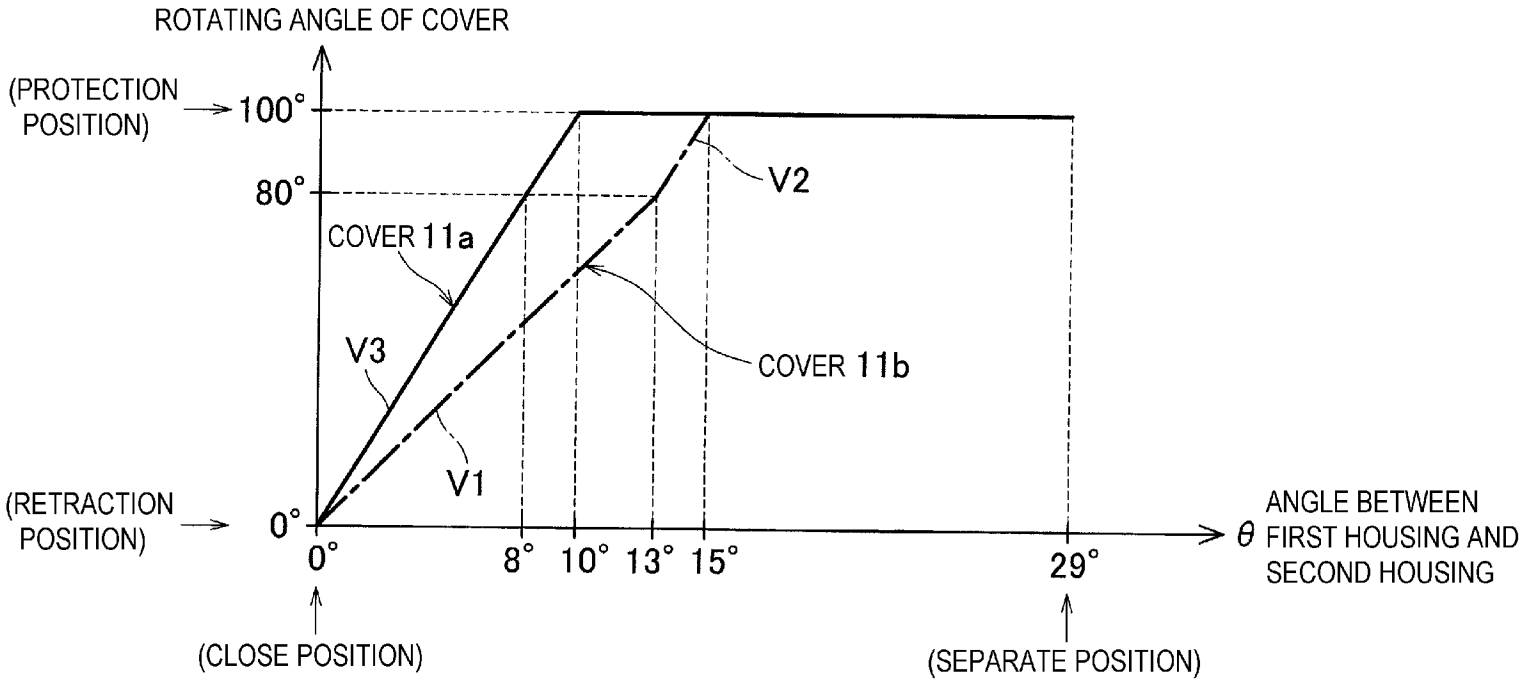
FIG. 6 is a graph showing a relation between the angle formed between the first housing and the second housing and a rotating angle of each cover.

As shown in FIG. 6, in this illustrative embodiment, rotating angles of the covers 11*a*, 11*b* from the retraction position to the protection position are 100°. The rotating angle of the cover 11*a* from the retraction position to the protection position refers to an angle A shown in FIG. 5D and the rotating angle of the cover 11*b* from the retraction position to the protection position refers to an angle B shown in FIG. 5D. That is, in this illustrative embodiment, both the angles A and B are 100°. Here, the angle A is an angle between an imaginary line L1 and an imaginary line L3 and the angle B is an angle between an imaginary line L2 and an imaginary line L4. The imaginary line L1 is a line connecting the shaft 12*a*1 of the side plate 12*a* and the pin 12*a*2 of the side plate 12*a* when the angle θ is 0°. The imaginary line L3 is a line connecting the shaft 12*a*1 of the side plate 12*a* and the pin 12*a*2 of the side plate 12*a* when the angle θ is 29°. The imaginary line L2 is a line connecting the shaft 12*b*1 of the side plate 12*b* and the pin 12*b*2 of the side plate 12*b* when the angle θ is 0°. The imaginary line L4 is a line connecting the shaft 12*b*1 of the side plate 12*b* and the pin 12*b*2 of the side plate 12*b* when the angle θ is 29°.

While the cover 11*a* reaches the protection position when the angle θ is 10°, the cover 11*b* reaches the protection position when the angle θ 15°.

FIG. 6 shows an amount of change of the rotating angles of the covers 11*a*, 11*b* with respect to the angle θ. In the cover 11*b*, the amount of change is V1 when the angle θ is 0° to 13°, V2 (>V1) when the angle θ is 13° to 15°, and zero when the angle θ is larger than 15°. In the cover 11*a*, the amount of change is V3 (>V1) when the angle θ is 0° to 10° and zero when the angle θ is larger than 10°.

In the course of the angle θ reaching 29° from 0°, after the covers 11*a*, 11*b* reach the protection position, the covers 11*a*, 11*b* and the intermediate members 13*a*, 13*b* and side plates 12*a*, 12*b* corresponding to the covers 11*a*, 11*b* are not moved relative to the support member 1*a*1 and the first housing 1*a* and are moved together with the support member 1*a*1 and the first housing 1*a* with being held to the support member 1*a*1 and the first housing 1*a*. In other words, in the course of the angle θ reaching 29° from 0°, after the angle θ exceeds the 10° in the cover 11*a* and the angle θ exceeds the 15° in the cover 11*b*, the covers 11*a*, 11*b* and the intermediate members 13*a*, 13*b* and side plates 12*a*, 12*b* corresponding to the covers 11*a*, 11*b* are not moved relative to the support member 1*a*1 and the first housing 1*a* and are moved together with the support member 1*a*1 and the first housing 1*a* with being held to the support member 1*a*1 and the first housing 1*a*.

When the first housing 1*a* is moved from the separate position to the close position, the operations of the intermediate members 13*a*, 13*b*, the side plates 12*a*, 12*b* and the covers 11*a*, 11*b* are opposite operations to the operations which are made when the first housing 1*a* is moved from the close position to the separate position.

As described above, according to the printer 1 of this illustrative embodiment, as shown in FIGS. 4A and 5A, the retraction position of the cover 11*a* is located at the left side (a side away from the head 10*b* other than the head 10*a*) of the corresponding head 10*a* and the retraction position of the cover 11*b* is located at the right side (a side away from the head 10*a* other than the head 10*b*) of the corresponding head 10*b*. Thereby, it is possible to reduce a distance between the heads 10*a*, 10*b*.

Also, for a case where it is necessary to provide a member (frame 3 or suction duct) between the heads 10*a*, 10*b*, when the retraction positions of the covers 11*a*, 11*b* are between the heads 10*a*, 10*b*, it may be difficult to arrange those member because the covers 11*a*, 11*b* become obstacles. However, according to this illustrative embodiment, since the retraction positions of the covers 11*a*, 11*b* are not located between the heads 10*a*, 10*b*, it is possible to easily arrange such members.

The covers 11*a*, 11*b* are configured to take the retraction position (refer to FIG. 4A) when the first housing 1*a* is located at the close position and the protection position (refer to FIG. 4D) when the first housing 1*a* is located at the separate position by the moving mechanism (the side plates 12*a*, 12*b*, the intermediate members 13*a*, 13*b*, the torsion coil springs 13*a*4, 13*b*4 and the guide parts 14*a*, 14*b*).

Thereby, a user can manually perform the jam resolving operation by using the space which is formed between the first housing 1*a* and the second housing 1*b* when the first housing 1*a* is located at the separate position. Also, it is possible to effectively protect the ejection surfaces 10*x* of the heads 10*a*, 10*b* from the user's hand or foreign matters by moving the covers 11*a*, 11*b* as the first housing 1*a* is moved (i.e., by moving the covers 11*a*, 11*b* in association with the first housing 1*a*).

Also, the moving mechanism is the mechanical mechanism, rather than an electrical mechanism. When an electrical mechanism is used as the moving mechanism, a configuration of the moving mechanism may be complicated or the moving mechanism may not be operated unless it is powered. Compared to this, in this illustrative embodiment, since the mechanical mechanism is used as the moving mechanism, a configuration of the moving mechanism is simplified and the moving mechanism is operated without electric power.

Also, the intermediate members 13*a*, 13*b* having the larger rotating radii than those of the covers 11*a*, 11*b* are provided as the moving mechanism. Accordingly, it is possible to effectively increase the rotating angles of the covers 11*a*, 11*b*, compared to a configuration in which the intermediate members 13*a*, 13*b* are not provided.

Since it is not necessary to secure a space between the heads 10*a*, 10*b* as the retraction position of the covers 11*a*, 11*b*, it is possible to arrange the roller pair 24 in the space and to thus improve the conveyance accuracy. If the roller pair 24 is omitted, the sheet P passes the position (recording position) facing the ejection surfaces 10*x* of the heads 10*a*, 10*b* while it is conveyed by the roller pair 23 arranged at the more upstream side than the heads 10*a*, 10*b* in the conveyance direction and/or the roller pair 25 arranged at the more downstream side than the heads 10*a*, 10*b* in the conveyance direction. When there is no roller pair 24 between the heads 10*a*, 10*b*, a distance between the roller pair 23 and the roller pair 25 is increased. Thus, a length of a part of the sheet P held and cantilevered only by the roller pair 23, which is at the more downstream side than the roller pair 23 in the conveyance direction, becomes longer. As a result, a problem where the corresponding part is floated upward and a problem where the corresponding part is floated upward and is thus brought into contact with the ejection surfaces 10*x* of the heads 10*a*, 10*b* may be caused. Also, the same problems may occur in a part of the sheet P held and cantilevered only by the roller pair 25, which is at the more upstream side than the roller pair 25 in the conveyance direction.

However, in this illustrative embodiment, the roller pair 24 is arranged between the heads 10*a*, 10*b*. Therefore, the part of the sheet P held by the roller pair 23, which is at the more downstream side than the roller pair 23 in the conveyance direction, is also held by the roller pair 24. Also, the part of the sheet P held by the roller pair 25, which is at the more upstream side than the roller pair 25 in the conveyance direction, is also held by the roller pair 24. Thereby, since it is possible to reduce the distance between the roller pairs with which the sheet P passing the recording position can be held, the above problems are suppressed and the conveyance accuracy is enhanced. In the meantime, in the roller conveyance configuration as this illustrative embodiment, the above problems may be remarkable when a plurality of line-type heads having the ejection surfaces 10*x*, which have the long lengths in the conveyance direction, is arranged in parallel in the conveyance direction. The lengths of the ejection surfaces 10*x* in the conveyance direction are preferably short so as to make the heads smaller. However, when the number of discharge ports is increased so as to improve the quality of an image, the lengths of the ejection surfaces tend to be longer.

Also, the upper roller 24*a* of the roller pair 24 is attached to the first housing 1*a*. Therefore, when the first housing 1*a* is moved from the close position to the remote position, the upper roller 24*a* is also moved together with the first housing 1*a*. Thereby, the conveyance path is exposed, so that it is possible to easily perform the jam process.

Also, the roller pair 24 is configured to convey the sheep P obliquely downward such that the sheet P is pressed to the support surface 9*x* of the platen 9*b* so as to prevent the sheet P from contacting the ejection surface 10*x* of the head 10*b*.

Therefore, the part of the sheet P held by the roller pair 24, which is at the more upstream side than the roller pair 24 in the conveyance direction, is floated upward, so that it may contact the ejection surface 10*x* of the head 10*a*.

However, since the intermediate roller 21 is arranged between the head 10*a* and the roller pair 24, even though the sheet P is floated, the floated part of the sheet P is suppressed by the intermediate roller 21. Thereby, it is possible to suppress the contact between the sheet P and the ejection surface 10*x* of the head 10*a*, the sheet P from being stained and the head 10*a* from being damaged.

Also, like the upper roller 24*a* of the roller pair 24, the intermediate roller 21 is also provided to the first housing 1*a*. Therefore, when the first housing 1*a* is moved from the close position to the remote position, the intermediate roller 21 and the upper roller 24*a* are moved together with the first housing 1*a*. Thereby, the conveyance path is exposed, so that it is possible to perform the jam process more easily.

Also, the upper rollers 23*a* to 25*a* of the roller pairs 23 to 25 and the intermediate roller 21 may contact the recording surface of the sheet P just after the recording and the image may be distorted due to the contact of the rollers to the recording surface. Thus, in this illustrative embodiment, the spur rollers are used as the above rollers. Thereby, even when the recording surface of the sheet P is brought into contact with the above rollers, the contact area of the roller to the recording surface is reduced (the roller is enabled to point-contact the recording surface), so that the distortion of the image is suppressed.

When the first housing 1*a* is rotated about the hinge part 1*h* serving as a rotational shaft from the close position toward the remote position, the angle θ (10°) formed when the cover 11*a* corresponding to the head 10*a* away from the hinge part 1*h* reaches the protection position is smaller than the angle θ (15°) formed when the cover 11*b* corresponding to the head 10*b* close to the hinge part 1*h* reaches the protection position (refer to FIG. 6).

That is, the moving of the covers 11*a*, 11*b* is made to be different between the head 10*a* away from the hinge part 1*h* serving as a rotational shaft and the head 10*b* close to the hinge part 1*h*. Thereby, it is possible to suppress the problem where the sheet P jammed on the conveyance path P is caught in the covers 11*a*, 11*b* (particularly, the cover 11*b* corresponding to the head 10*b* close to the hinge part 1*h*) and the problem where the user's hand is brought into contact with the ejection surfaces 10*x* of the heads 10*a*, 10*b* (particularly, the head 10*a* distant from the hinge part 1*h*).

While the present invention has been shown and described with reference to certain illustrative embodiments thereof, it will be understood by those skilled in the art that various changes in form and details may be made therein without departing from the spirit and scope of the invention as defined by the appended claims.

[Cover]

A sponge absorbing the liquid and the like may be provided to a part of the cover facing the ejection surface. In this case, it is possible to suppress the liquid leaked from the ejection ports from scattering into the liquid ejection apparatus.

The cover may cover the entirety or a part of the ejection surface.

[Moving Mechanism of Over]

In the above illustrative embodiment, the side plates 12*a*, 12*b*, the intermediate members 13*a*, 13*b*, the torsion coil springs 13*a*4, 13*b*4 and the guide parts 14*a*, 14*b* are exemplified as the moving mechanism. However, the other mechanisms may be also employed. It may be possible to arbitrarily change the shapes and the like of the side plates 12*a*, 12*b*, the intermediate members 13*a*, 13*b*, the torsion coil springs 13*a*4, 13*b*4 and the guide parts 14*a*, 14*b*. For example, the intermediate members 13*a*, 13*b* may be omitted and the side plates 12*a*, 12*b* may be enabled to function as the intermediate members (that is, a configuration may be possible in which the side plates 12*a*, 12*b* directly contact the guide parts 14*a*, 14*b* and the covers 11*a*, 11*b* are moved according to the contact states therebetween.). Also, the moving mechanism is not limited to the mechanical mechanism and may be an electrical mechanism.

In the above illustrative embodiment, the rotating angle of the cover is 100°. However, the rotating angle is not particularly limited. Also, the rotating angles of the two covers may be different from each other.

The angle formed between the first housing and the second housing when the covers reach the protection may be different or same for each of the covers.

When the first housing is rotated from the close position toward the separate position, the moving amounts of the covers with respect to the angle between the first housing and the second housing may be constant without stepwise changing.

The moving mechanism is not limited to the configuration of rotating the covers and may move the covers along one direction (for example, vertical or horizontal direction (not rotating manner)).

The moving mechanism may move the covers independently from the movement of the first housing not according to the movement of the first housing.

[Housing]

The first housing may be moved between the close position and the separate position as the controller controls a mechanical mechanism, not by the user's manual operation.

The first housing is rotatable relative to the second housing in the above illustrative embodiment, but is not limited thereto. The first housing may be movable in a vertical direction or a horizontal direction relative to the second housing.

[Conveyance Mechanism]

Both rollers of the roller pair arranged between the heads may be provided to the second housing.

The roller pair which is arranged between the heads may be omitted.

The intermediate roller 21 may be omitted.

The roller which can contact the recording surface of the recording medium just after the recording may not be the spur roller.

[Head]

The head may eject any liquid, other than the pre-processing liquid or ink.

[Others]

The recording medium is not limited to the sheet P and may be any recordable medium.

The present invention is not limited to the printer and can be applied to a facsimile, a copier and the like.

What is claimed is:

1. A liquid ejection apparatus comprising:

two line-type heads, each of which extends along a main scanning direction and includes an ejection surface having a plurality of ejection ports for ejecting liquid to a recording medium, wherein the two heads are arranged in a sub-scanning direction orthogonal to the main scanning direction; and two covers provided for the two heads, respectively, and each of the covers being movable relative the corresponding head between a protection position where the cover covers the ejection surface of the corresponding head and a retraction position where the cover does not cover the ejection surface of the corresponding head, wherein each of the heads includes a first side close to a head other than the corresponding head and a second side away from the head other than the corresponding head, and wherein the retraction position of each of the covers is located at the second side of the corresponding head such that the two heads are disposed between the two covers in the sub-scanning direction.

2. The liquid ejection apparatus according to claim 1, further comprising:

a first housing:

a second housing, wherein the first housing accommodates the two heads and is movable relative to the second housing between a close position where the first housing comes close to the second housing and a separate position where the first housing is separated from the second housing more than in the close position; and a moving mechanism configured to move each of the two covers according to the movement of the first housing so as to take the retraction position when the first housing is located at the close position and take the protection position when the first housing is located at the separate position.

3. The liquid ejection apparatus according to claim 2, further comprising:

a conveyance mechanism including a pair of rollers arranged between the two heads, the pair of rollers including a first roller rotatably attached to the first housing and a second roller rotatably attached to the second housing, the conveyance mechanism being configured to convey a recording medium to pass positions facing the ejection surfaces of the two heads, respectively, and between the first roller and the second roller.

4. The liquid ejection apparatus according to claim 2, wherein the first housing is rotatable relative to the second housing about a rotational axis extending in a direction orthogonal to an arrangement direction of the two heads, and wherein when the first housing is moved from the close position toward the separate position, the moving mechanism is configured to move the two covers such that an angle formed between the first housing and the second housing when the cover corresponding one of the two heads away from the rotational axis reaches the protection position is smaller than an angle formed between the first housing and the second housing when the cover corresponding to the other of the two heads close to the rotational axis reaches the protection position.

5. A liquid ejection apparatus comprising:

first and second line-type heads, each of which extends along a main scanning direction and includes an ejection surface having a plurality of ejection ports for ejecting liquid to a recording medium, wherein the first head and the second head are arranged in a sub-scanning direction orthogonal to the main scanning direction; and first and second covers provided for the first and second heads, respectively, and each of the covers being movable relative the corresponding head between a protection position where the cover covers the ejection surface of the corresponding head and a retraction position where the cover does not cover the ejection surface of the corresponding head, wherein the retraction position of the first cover with respect to the first head is opposite to the retraction position of the second cover with respect to the second head in the sub-scanning direction such that the first head and the second head are disposed between the first cover and the second cover in the sub-scanning direction.

6. A liquid ejection apparatus comprising:

two line-type heads, each of which includes an ejection surface having a plurality of ejection ports for ejecting liquid to a recording medium;

two covers provided for the two heads, respectively, and each of the covers being movable relative the corresponding head between a protection position where the cover covers the ejection surface of the corresponding head and a retraction position where the cover does not cover the ejection surface of the corresponding head; and a moving mechanism configured to move each of the two covers, wherein the moving mechanism includes:

two side plates provided for the two covers, respectively, and each of the side plates being rotatable about a first shaft to move the corresponding cover; and two intermediate members engaged with the two side plates, respectively, and each of the intermediate members being rotatable about a second shaft which is provided between the first shafts of the two side plates.

* * * * *